US006491237B1

(12) United States Patent
Coppola et al.

(10) Patent No.: US 6,491,237 B1
(45) Date of Patent: Dec. 10, 2002

(54) FUEL INJECTOR NOZZLE

(75) Inventors: Edoardo Coppola, Long Beach, CA (US); Norman Hsu, Rancho Palos Verdes, CA (US)

(73) Assignee: Hatch & Kirk, Inc., Seattle, WA (US)

( * ) Notice: Subject to any disclaimer, the term of this patent is extended or adjusted under 35 U.S.C. 154(b) by 0 days.

(21) Appl. No.: 09/591,985

(22) Filed: Jun. 12, 2000

(51) Int. Cl.[7] ..... B05M 59/00; F02M 61/08; F02M 61/20; B05B 1/30

(52) U.S. Cl. ..... 239/533.2; 239/533.7; 239/533.9; 239/585.5

(58) Field of Search ..... 239/533.2, 533.3, 239/533.4, 533.5, 533.6, 533.7, 533.8, 533.9, 533.12, 584, 585.5

(56) References Cited

U.S. PATENT DOCUMENTS 4,106,702 A * 8/1978 Gardner et al. ..... 239/533.3
5,037,031 A * 8/1991 Campbell et al. ..... 239/533.3
5,042,721 A * 8/1991 Muntean et al. ..... 239/533.3
5,449,121 A * 9/1995 El-Darazi et al. ..... 239/533.3
5,890,660 A * 4/1999 Stevens ..... 239/533.3
6,155,504 A * 12/2000 Sugimoto et al. ..... 239/596

* cited by examiner

*Primary Examiner*—Henry C. Yuen
*Assistant Examiner*—Davis Hwu
(74) *Attorney, Agent, or Firm*—Marcia Devon

(57) ABSTRACT

A fuel injector nozzle is disclosed which solves a long-standing problem in the industry of reducing polluting engine emissions. The nozzle has a needle which alternately blocks and leaves open spray holes for delivering fuel to the combustion chamber. The needle is received in a cavity where the injector needle seats. Machining the seat of the cavity causes a sac at the nozzle tip where the unburned fuel causes the polluting emissions. Minimizing the sac volume minimizes the polluting emissions. The present invention discloses a nozzle formed with a seat having an apex located at the bottom of a sac. The design of the present minimizes the sac volume and the sac volume is closer to zero volume than any prior design.

9 Claims, 6 Drawing Sheets

FUEL INJECTOR NOZZLE

FIELD OF THE INVENTION

The present invention is a differential needle valve nozzle which is used in a fuel injection system in diesel engines, particularly used with locomotive engines, marine and electric power generation The fuel injection systems are often called unit injectors or EMD injectors (originally manufactured by the Electro-Motive division of General Motors).

BACKGROUND OF THE INVENTION

The unit injectors typically have a nozzle valve body forming a tip or "nose" at one end. Another basic component of the fuel injector is the nozzle valve. The nozzle valve or "needle" moves up and down within the nozzle body, alternatively opening and closing fuel ducts and spray holes through which fuel is sprayed.

One of the major problems faced by the diesel engine industry is the increasingly stringent standards for emissions to protect the environment from noxious gases which are a by-product of the internal combustion process. The U.S. Environmental Protection Agency (EPA) is particularly concerned about the amount of nitrogen oxides, carbon monoxide, hydrocarbons and other polluting gases from the engine exhaust.

The outside walls of the nozzle tip form an inverted dome. A cavity is formed inside the nozzle tip to receive the needle. The needle stops or seats on the needle's down stroke when it strikes the inside walls of the nose. The location where the needle stops is the seat. In machining strikes the inside walls of the nose. The location where the needle stops is the seat. In machining the inside walls of the seat, a nipple or "sac" is inevitably created. It is well known in the industry that reducing the sac volume of the fuel injection nozzles reduces the amount of hydrocarbon emissions. Fuel in the sac was forced out of the nozzle after injection was completed, entering the combustion cycle at a time when it could not burn. The fuel passed through the cycle causing unburned, polluting emissions.

The problem faced by the industry is how to minimize the sac volume while maintaining a constant wall thickness, maintaining the spray hole location and other design constraints. It is also desirable to maintain the ratio of the length over the diameter of the spray holes as a prescribed constant.

Prior art patents, e.g. U.S. Pat. 5,467,924, disclose a fuel injector with a reduced sac volume. The present invention accomplishes the delivery of fuel with no sac, or a sac which is minimal, substantially reducing the sac over any prior design.

SUMMARY OF THE INVENTION

As recognized in prior art patents and in the industry, reducing the sac volume of the fuel injection nozzles is not a simple matter. The wall thickness of the inverted dome forming the nose of the nozzle is important for durability and to maintain the structural integrity of the nozzle. The spray hole location in the combustion chamber is a critical design constraint. Also, the ratio of spray hole length to spray hole diameter (L/D) must be maintained at a pre-determined constant value. There are also inherent limitations as a result of the machining process.

The present invention reduces the sac volume significantly so that it is close to zero, and is substantially less than any prior art design, while fulfilling each of the above-mentioned design criteria. The injector includes an injector body, a spring-loaded plunger, a check valve, and fuel ducts feeding a fuel chamber, a spring-loaded valve or "needle", spray holes through the walls of the injector body, an inverted dome-shaped outside walls, and a seat formed by the inside walls of the nozzle with substantially minimized sac size while maintaining the established wall thickness required for reliability. The inverted dome forming the outside walls of the nozzle nose is conventional and has a specified radius. The walls of the nozzle interior are machined to form a cavity with an angled seat or valve guide to receive the needle. The nozzle interior terminates in a minuscule sac having almost no volume. The sac has a minimal volume which is much closer to zero than any prior art design. Spray holes are provided for delivery of the fuel and must be properly located. The ratio of the spray hole length to diameter should be maintained as a constant.

The valve or needle permits fuel delivery through the injector body and the nozzle by blocking and unblocking the spray holes. In contrast to the prior art, the apex of the valve seat is at the bottom of the sac which reduces the sac to the minimum possible volume. Spray holes are provided at certain locations with the proper length to diameter ratio to deliver the fuel through the nozzle body by blocking and unblocking the holes with the needle valve.

DETAILED DESCRIPTION OF THE PREFERRED EMBODIMENTS

Figure 1:
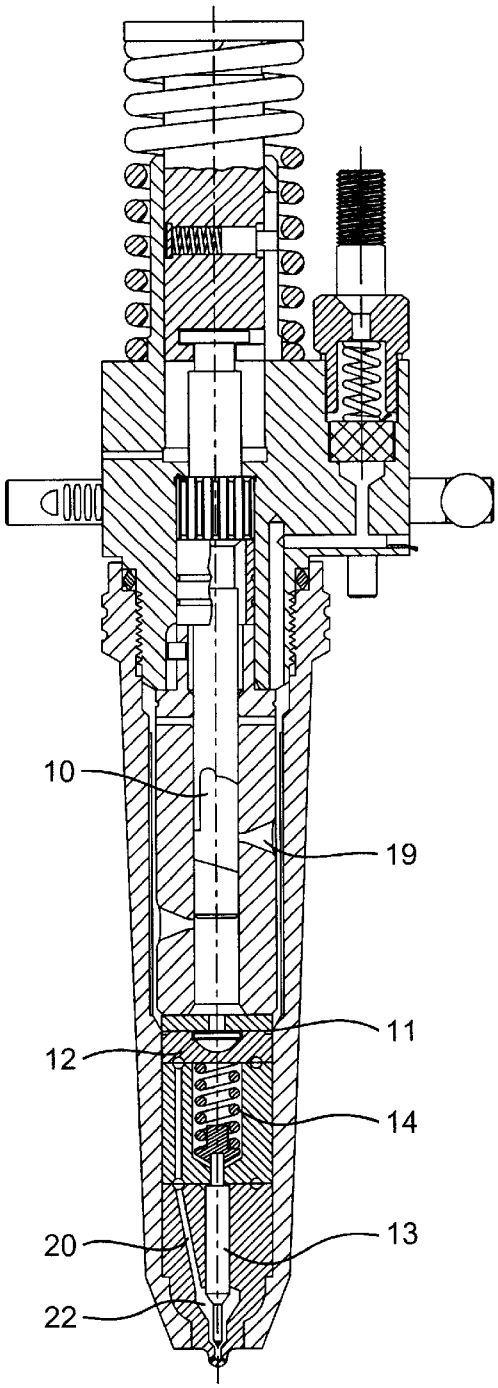
FIG. 1 (PRIOR ART)
FIG. 1 is a cross-sectional view of an EMD type of fuel injector disclosed in the prior art.
Figure 2:
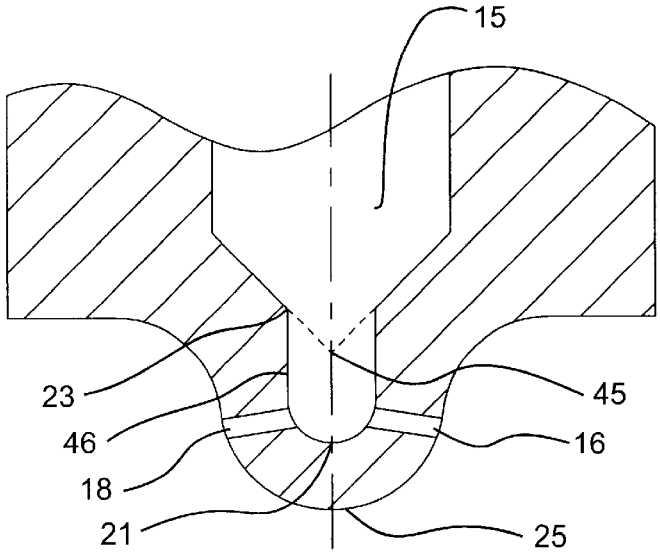
FIG. 2 (PRIOR ART)
FIG. 2 is an enlarged, cross-sectional view of the EMD type of nozzle valve body of the prior art.

A typical diesel fuel injector is shown in cross section in FIGS. 1 and 2. In a conventional injector and as well as in the present invention, fuel is supplied from the fill port 19, through the fuel ducts 20, which supplies the fuel chamber 22. The pressure which causes the fuel chamber to fill with fuel is due to the action of the plunger 10. The plunger 10 moves downward creating fuel pressure against a check valve 11, a check valve cage 12 pushes the needle up against the bias of the spring 1. The spring forces the valve or "needle" 13 upward through the cavity 15 (the unshaded area in the drawings) and separates from the seat 23.

FIG. 2 is an enlarged cross-sectional view of a portion of the injector shown in FIG. 1. When the needle is in the upstroke and is above the valve seat 23, pressurized fuel is permitted to pass the valve seat 23 and through the spray holes 16 and 18, delivering an atomized fuel to the combustion chamber.

In the preferred embodiment of the present invention and in most of the conventional injectors, there are a plurality of spray holes placed radially around the center line axis shown in phantom lines in FIGS. 2–5. (Only two spray holes are illustrated in FIGS. 2–5). The number, diameter and position of the spray holes must be carefully chosen to provide good atomization of the fuel entering the combustion chamber (not shown) and the optimum air-fuel mixture throughout the engine's full operating range.

The outside walls of the tip of the nozzle forms an inverted dome 25 with a radius R1 and a fairing zone with a reverse radius R3. The interior walls of the nozzle are formed with a valve seat 23 which receives the needle.

The valve seat 23 is machined into the walls 30 with small grinding wheel (approximately ⅛ to ¼ inches in diameter). A small space or "sac" 46 is pre-machined to prevent the grinding wheel from striking the walls 30 when the wheel oscillates during the grinding process.

The design of the present invention requires the apex 45 of the seat 23 to be at the same point at the bottom of the sac 21, as shown in FIGS. 3–7, thereby minimizing the volume of the sac, while satisfying all of the design constraints. In contrast, the prior art designs place the bottom of the sac 21 below the apex 45 of the seat 23, as shown in FIG. 2.

The design constraints include: (1) the wall thickness must not be reduced past a minimum amount in order to maintain structural integrity; (2) the ratio of the length and the diameter of the spray holes must be maintained as a pre-determined constant; and (3) the spray holes must be maintained at the same vertical distance, SD, from the shoulder 17. The present invention achieves all of these design constraints by having the outside wall fairing zone 52 with a reverse radius R3 and a dome radius R1 greater than the sac radius R2. The dome radius R1 and the sac radius R2 have the same center point.

The pressure required to open the valve is greater than the pressure required to close the valve. Most unit injectors, including the preferred embodiment of the present invention, are set to an opening pressure of between 2800–3400 psi. Higher opening pressures increase the stress on the nozzle springs and seats, causing them to wear faster.

The needle moves up and down rapidly many times per second. The needle is moving so rapidly and has a small enough mass that the combination causes the needle to vibrate. The mass of the needle is a design factor because as the mass of the needle increases, so does the force impacting the valve seat, shortening the life span of seat. It is therefore desirable to have the mass of the needle as small as possible while meeting the other design constraints. The present invention reduces the volume of the sac and satisfies all of the design constraints without increasing the mass of the needle.

Figure 3:
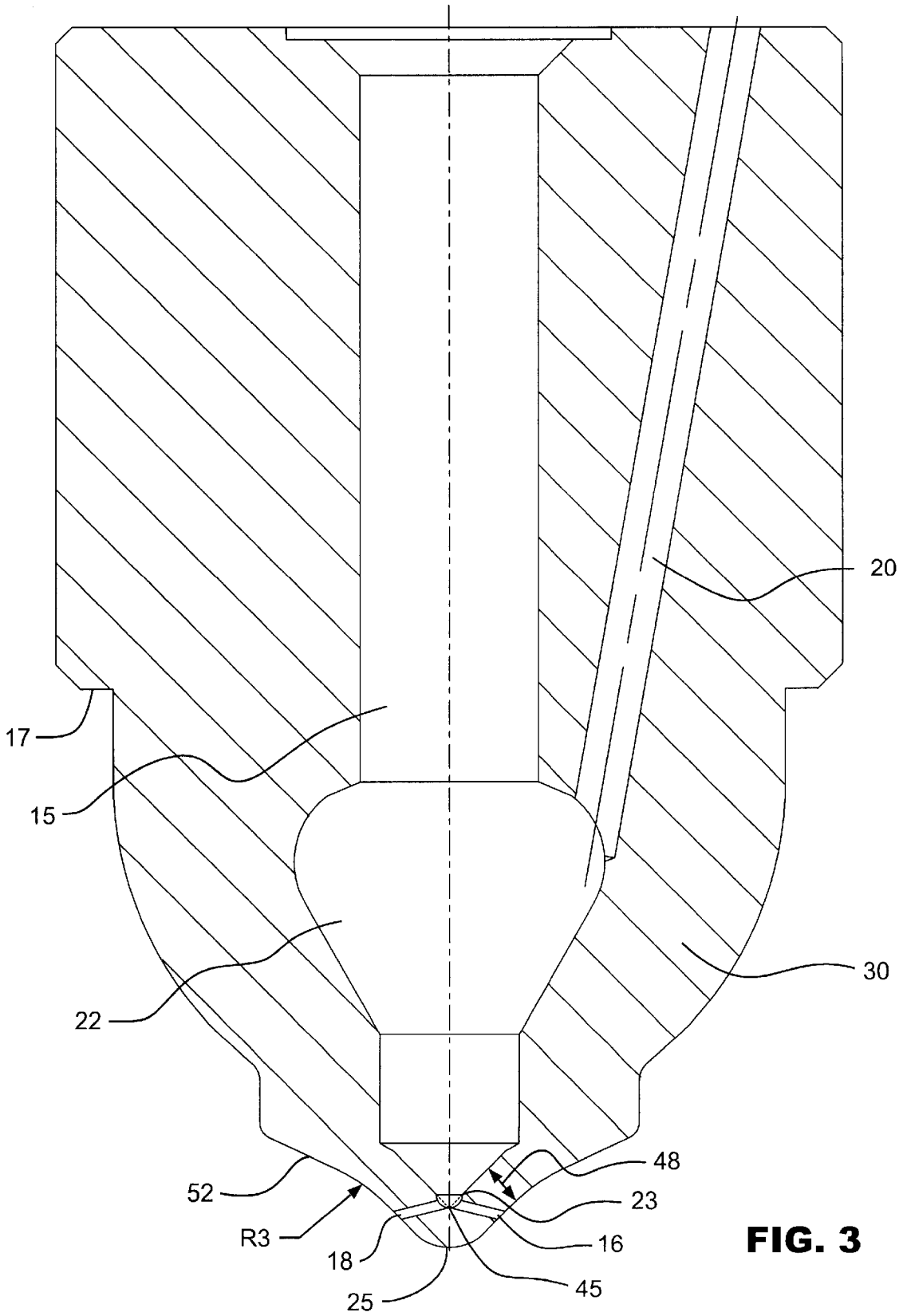
FIG. 3 is an enlarged cross-sectional drawing of an embodiment of the present invention.
Figure 4:
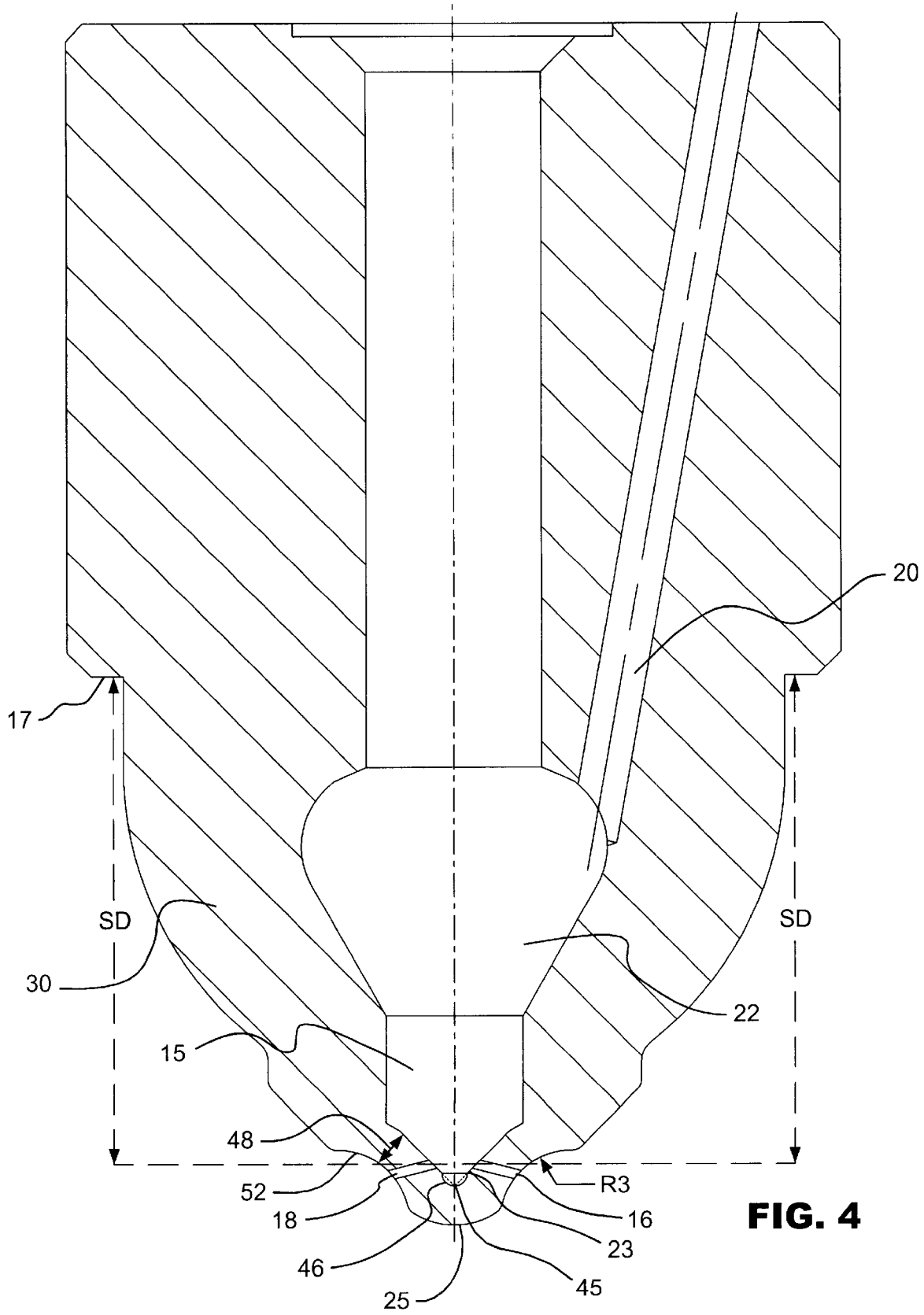
FIG. 4 is a cross-sectional view of an embodiment of the present invention.
Figure 5:
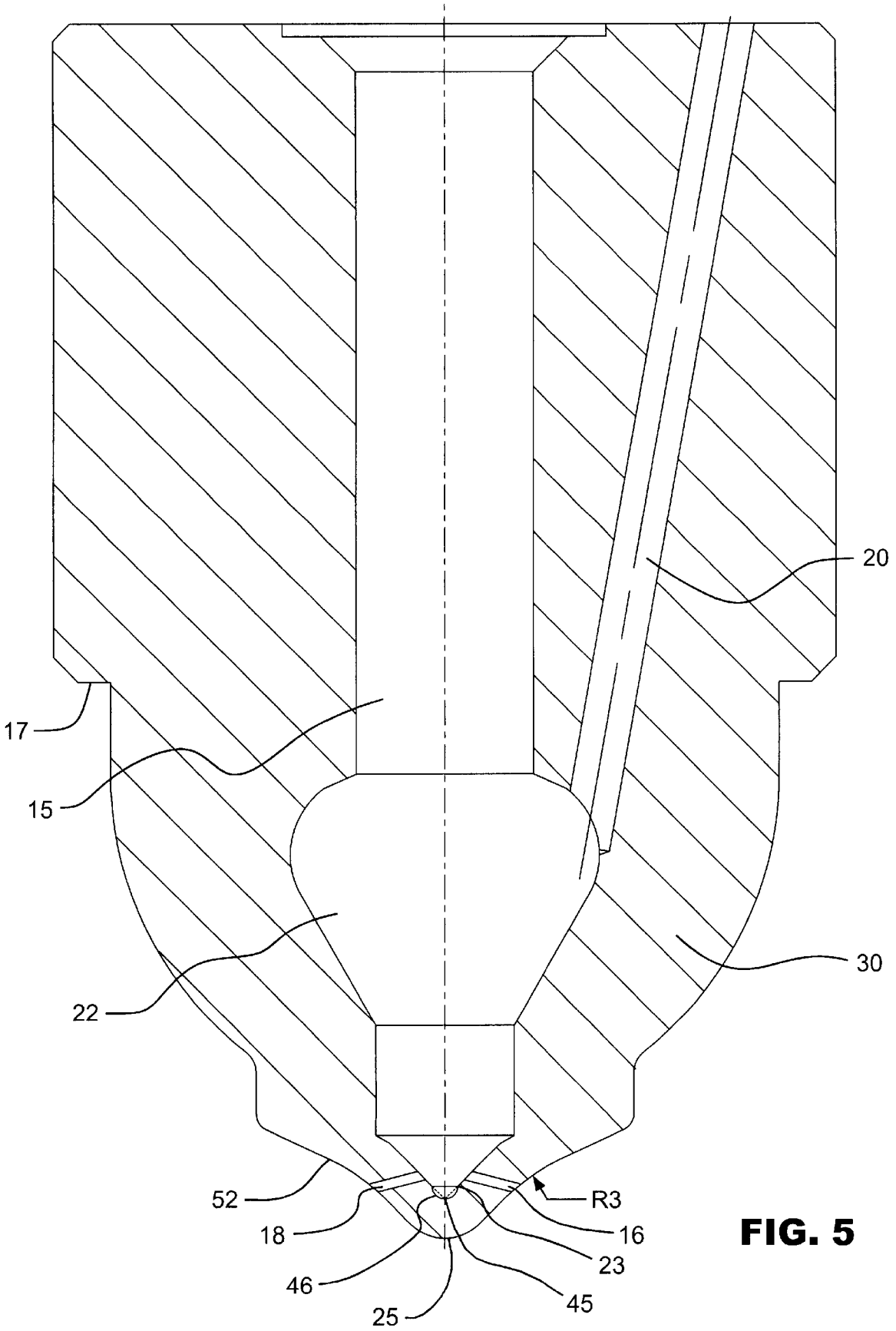
FIG. 5 is a cross-sectional view of an injector showing an embodiment of the present invention.
Figure 6:
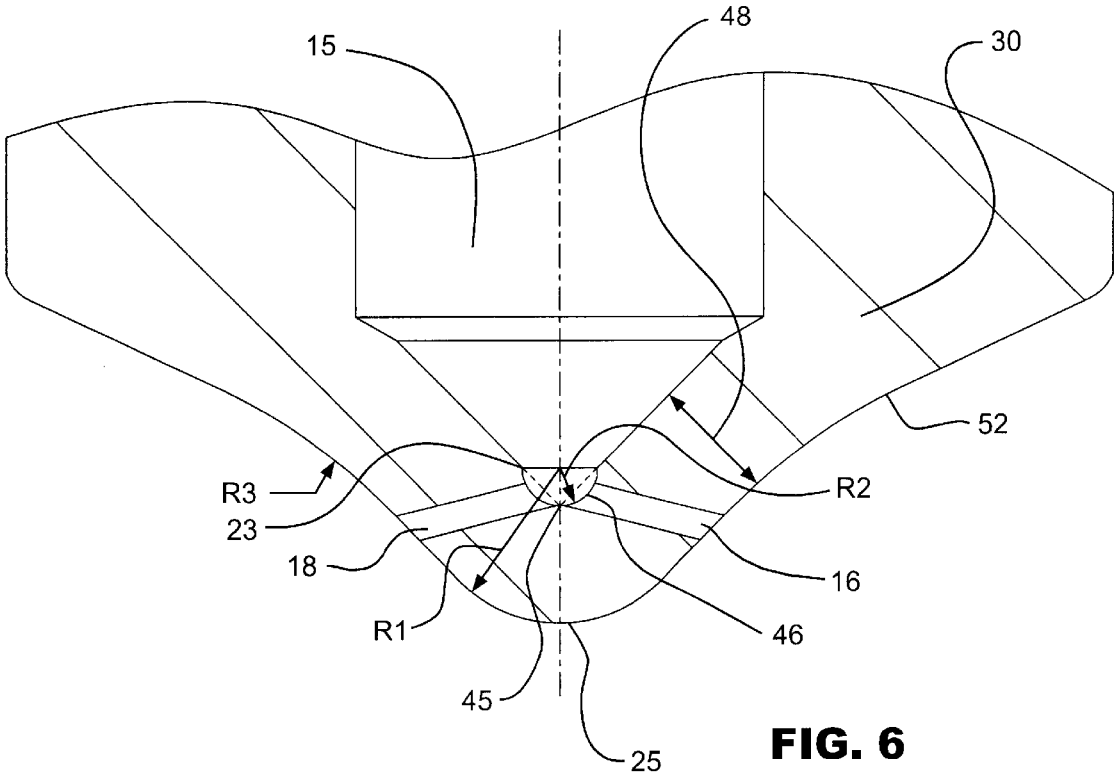
FIG. 6 is an enlarged cross-sectional view of the injector shown in FIG. 3.
Figure 7:
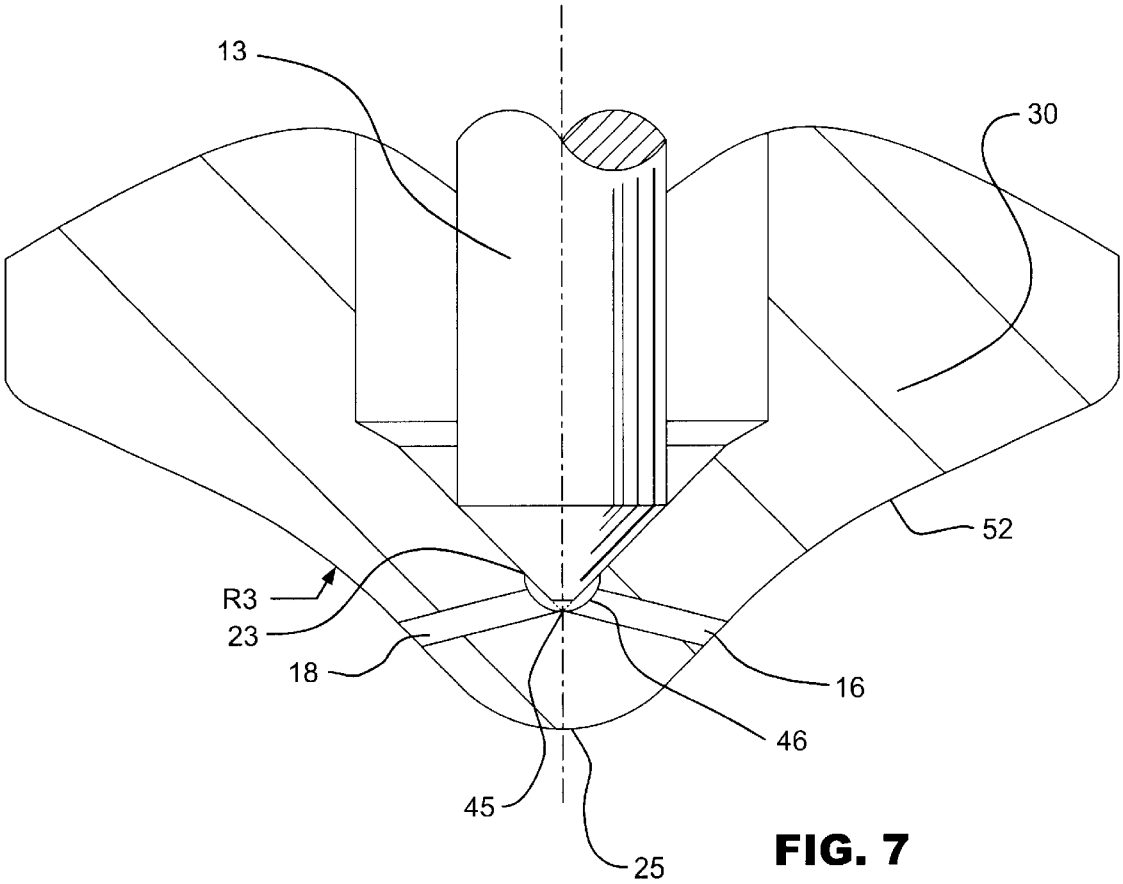
FIG. 7 is an enlarged cross-sectional view of the injector of FIG. 3 which includes the valve.

FIGS. 3–5 illustrate variations of the present invention. In FIG. 3, 6 and 7, the spray holes 16 and 18 are placed at the sac, with the sac 46 bottom coinciding with the apex 45 of the seat 23. The apex 45 of the seat 23 is shown as an (imaginary) extension of the interior walls 30 in the phantom lines shown in FIGS. 2–5.

In the embodiment shown in FIG. 4, the spray holes 16 and 18 are placed at the seat above the sac 46 (which is known as valve-covered orifice or "VCO" technology). The outside walls are machined forming stepped shoulders with a reverse radius R3, rather than large, rounded curves as in FIG. 3 and FIG. 5 in order to maintain the proper wall thickness 48, as well as the length-to-diameter ratio. Other dimensions of the tip, including the location of the sac bottom, must also be altered to maintain the spray hole locations. FIG. 5 has outside walls 52 with the reverse radius R3 similar to the outside walls shown in FIG. 3, and has VCO spray holes placed above the sac. It will be appreciated that a variety of designs are possible and there are a number of different embodiments of the present invention.

The steel used in constructing the nozzle may be case-hardened with a soft core. Various made more precisely by electrical discharge machining (EDM) though the outside wall to the inside wall of the nozzle. EDM avoids creating burrs which occur when the spray holes are drilled.

It will be appreciated that one skilled in the art may ascertain the essential characteristics of the invention, including being used with different types of engines and alternate parts, without departing from the spirit and scope of the invention, and make various changes and modifications to adapt it to various uses.

We claim:

1. A fuel injector nozzle having a body and fuel ducts for delivering fuel, comprising:

a cavity within the body of the fuel injector forming a chamber connected to the fuel ducts and connected to said chamber, the body having inside and outside walls and cylindrical spray holes having a length from said inside walls to said outside walls and a diameter wherein the ratio of said spray hole length divided by said diameter is maintained as a predetermined constant and wherein said inside walls of said cavity terminates in a valve seat and sac, said seat having an apex and said sac having a bottom point and a center;

an inverted dome formed by said outside walls of said cavity, said dome having a radius and a center at the same point as said center of the said sac wherein said dome radius is greater than said sac radius and;

a valve having a tip, said valve traveling in downward and upward strokes, respectively blocking and unblocking said spray holes, wherein said valve stops in its downward stroke at said valve seat, said apex of said valve seat is at the same point as said bottom point of said sac and said valve tip travels to the bottom point of the sac during said downward stroke.

2. The fuel injector nozzle of claim 1 wherein said spray holes are located adjacent to the apex of said valve seat.

3. The fuel injector nozzle of claim 1 wherein said spray holes are located above the apex of said seat.

4. The fuel injector nozzle of claim 1 wherein the outside walls of the injector body form notch-shaped shoulders above said dome.

5. The fuel injector nozzle of claim 1 wherein the outside walls of the injector body form squared shoulders above said dome.

6. The fuel injector nozzle of claim 1 wherein said spray holes are located adjacent to the apex of said valve.

7. The fuel injector nozzle of claim 1 wherein said spray holes are located above the apex of said seat.

8. The fuel injector nozzle of claim 1 wherein said outside walls form a dome having a radius and a fairing zone with a reverse radius whereby said reverse radius is greater than or equal to said dome radius.

9. The fuel injector nozzle of claim 1 wherein said outside walls form a dome having a radius and a fairing zone with a reverse radius whereby said reverse radius is greater than or equal to said dome radius.

* * * * *